US005809385A

United States Patent [19]

Snelling et al.

[11] Patent Number: 5,809,385

[45] Date of Patent: Sep. 15, 1998

[54] REPRODUCTION MACHINE INCLUDING AND ACOUSTIC SCAVENGELESS ASSIST DEVELOPMENT APPARATUS

[75] Inventors: Christopher Snelling, Penfield; Dan A. Hays, Fairport; Jeffrey J. Folkins, Rochester; Dale R. Mashtare, Macedon, all of N.Y.

[73] Assignee: Xerox Corporation, Stamford, Conn.

[21] Appl. No.: 886,103

[22] Filed: Jun. 30, 1997

[51] Int. Cl.[6] ..... G03G 15/08

[52] U.S. Cl. ..... 399/266; 399/291

[58] Field of Search ..... 399/266, 267, 399/270, 271, 290, 291

[56] References Cited

U.S. PATENT DOCUMENTS

| | | | |
|---|---|---|---|
| 4,078,929 | 3/1978 | Gundlach | 96/1.2 |
| 4,273,069 | 6/1981 | Huggins et al. | 399/267 |
| 4,546,722 | 10/1985 | Toda et al. | 399/267 |
| 4,568,955 | 2/1986 | Hosoya et al. | 346/153.1 |
| 4,647,179 | 3/1987 | Schmidlin | 399/285 |
| 4,833,503 | 5/1989 | Snelling | 399/231 |
| 4,868,600 | 9/1989 | Hays et al. | 399/266 |
| 4,987,456 | 1/1991 | Snelling et al. | 399/319 |
| 4,994,859 | 2/1991 | Mizuno et al. | 399/266 |
| 5,010,367 | 4/1991 | Hays | 399/266 |
| 5,255,059 | 10/1993 | Kai et al. | 399/265 |
| 5,339,142 | 8/1994 | Hays | 399/253 |
| 5,523,827 | 6/1996 | Snelling et al. | 399/285 |

FOREIGN PATENT DOCUMENTS

| | | |
|---|---|---|
| 4-346373 | 12/1992 | Japan . |
| 4-347878 | 12/1992 | Japan . |

*Primary Examiner*—William J. Royer
*Attorney, Agent, or Firm*—Tallam I. Nguti

[57] ABSTRACT

An acoustic scavengeless assist (ASA) development apparatus, and a multicolor image reproduction machine including such a development apparatus. The (ASA) development apparatus includes a biased vibratory section having a piezoelectric member and a donor member, as well as, a development electrode section, for presenting toner particles to latent electrostatic images for image development. The donor member is positioned within the reproduction machine and forms a development nip with a latent image bearing surface of a photoreceptor of the reproduction machine. Importantly, the biased vibratory section has at least a first conductive electrode formed therein adjacent to the piezoelectric member for effecting controlled vibratory toner release from the donor member, and a first bias for biasing the at least first conductive electrode. The development electrode section includes a set of second conductive electrodes and a second bias therefor, and is located between the at least first electrode and the latent image bearing surface, for enhancing toner particle release from the donor member, and powder cloud formation within the development nip for quality image development.

18 Claims, 5 Drawing Sheets

REPRODUCTION MACHINE INCLUDING AND ACOUSTIC SCAVENGELESS ASSIST DEVELOPMENT APPARATUS

BACKGROUND OF THE INVENTION

The present invention relates to electrostatographic reproduction machines, and more particularly to such a machine including an acoustic scavengeless assist (ASA) development apparatus having increased toner release control, and reduced image degradation of a previously developed image when subsequent latent images are developed with different color toners.

The present invention can be utilized in the art of xerography or in the printing arts. In the practice of conventional xerography, it is the general procedure to form electrostatic latent images on an image bearing surface of a uniformly charged photoreceptor. The charge on the surface is selectively dissipated in accordance with an imagewise pattern of activating radiation corresponding to original images. The selective dissipation of the charge leaves a latent pattern of charged and discharged or charge dissipated areas on the imaging surface. In what is referred to as a Charged Area Development (CAD) environment, the discharged or charge dissipated areas on the photoreceptor correspond to residual or background voltage levels, and the still charged areas correspond to image areas. In what is referred to as a Discharged Area Development (DAD) environment, the discharged or charge dissipated areas on the photoreceptor correspond to residual or background voltage levels, and the discharged areas correspond to image areas.

In either environment, the image areas are then developed or rendered visible with charged toner particles. The charged toner particles generally comprise a colored powder whose particles adhere to the charge pattern on the image bearing surface, thus forming a toner developed image.

The toner developed image is then first transferred to a receiving substrate, such as plain paper, to which it is then heated and fixed by any suitable fusing technique.

Conventional xerographic imaging techniques which were initially limited to monochrome image formation have been extended to the creation of color images, including process as well as highlight multicolor images. In either case, particularly in single pass multicolor image process machines and highlight color machines, toner developed images from an upstream development unit of the machine must be moved through the development fields of a downstream development unit. Scavenging or undesirable removal of some of the toner particles from the previously developed image, usually resulting in a less than desired quality final image, is ordinarily a problem in such multicolor machines.

Non-interactive development techniques and apparatus have been proposed for use in such multicolor image machines in order to reduce such scavenging, as well as, interaction between the previously developed image and the downstream development fields, in order to improve the developed image quality. Such donor-development or non-interactive development techniques include conventional prior art development electrode types, for example, the exposed development electrode wire technique, and the embedded development electrode techniques, examples of which will be described below. Such non-interactive development techniques also include conventional vibratory or acoustic techniques, for example, that using sonic toner release, that using a piezo-active donor roll, and that using an acoustic transducer, examples of which will also be described below.

Following then is a discussion of examples of such prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 5,523,827 entitled Piezo Active Donor Roll (PAR) For Store Development, issued Jun. 4, 1996, to Snelling et al., discloses a vibratory type development system which uses a donor roll structure including a piezoelectric layer for liberating toner particles from its surface. The donor roll is provided with a plurality of electrodes spaced about the circumference of the roll. An AC voltage is applied to the electrodes as they pass through a developer nip or zone intermediate the donor roll and an imaging member containing latent electrostatic images. The voltage is applied to each electrode and another continuous electrode which together sandwich the piezoelectric layer therebetween such that an AC voltage is applied across a portion of the piezoelectric layer in the nip thereby causing acoustic excitation of the portion of the layer only in the nip.

U.S. Pat. No. 5,339,142 entitled AC/DC Spatially Programmable Donor Roll For Xerographic Development and issued Aug. 16, 1994, to Hays, discloses a development electrode type non-interactive development system for use in color imaging. To control the developability of lines and the degree of interaction between the toner and receiver, an AC voltage is applied between a donor roll and electrodes supported adjacent to the surface of the donor roll to enable efficient detachment of toner from the donor to form a toner cloud. An AC voltage applied between the donor roll assembly and an image receiver serves to position the cloud in close proximity to the image receiver for optimum development of lines and solid areas without scavenging a previously toned image.

U.S. Pat. No. 4,546,722 granted on Oct. 15, 1985, to Toda et al discloses a vibratory or acoustic type development apparatus having a toner carrying member and a piezoelectric vibrator for displacing toner from the toner carrying member and causing it to fly in a manner to avoid depositing toner onto a non-image area of an image bearing surface. Such an arrangement prevents degradation of the charged image for the purpose of image preservation. Toner release control and adverse, image degradation influences are still likely, given the magnitude of the electrostatic fields.

U.S. Pat. No. 4,987,456 granted to Snelling et al., on Jan. 22, 1991, is directed to a conventional vibratory or acoustic type apparatus in which a resonator suitable for generating vibratory energy is arranged in line contact with the back side of a charge retentive member bearing an image on a surface thereof, in an electrophotographic device, to uniformly apply vibratory energy to the charge retentive member. The resonator comprises a vacuum producing element, a vibrating member, and a seal arrangement. Where the vibratory energy is to be applied to the charge retentive surface, a vacuum is applied by the vacuum producing element to draw the surface into intimate engagement with the vibrating member, and edge seal arrangement. The invention has application to a transfer station for enhancing electrostatic transfer of toner from the charge retentive surface to a copy sheet, and to a cleaning station, where mechanical vibration of the surface will improve the release of residual toner remaining after transfer.

U.S. Pat. No. 5,255,059 granted on Oct. 19, 1993, to Kai et al., discloses a vibratory or acoustic type image forming apparatus incorporating a stationary, hollow cylindrical donor structure including a single set of electrodes within its hollow, and a piezoelectric layer formed over the electrodes. The donor structure may be in the form of a roll or a belt. In each embodiment disclosed, a phase shifted voltage is applied to the electrodes for the purpose of creating a waving action which is effective to transport toner particles from a sump to a development zone. Thus, while the toner is moved through acoustic action alone of the waving materials, the donor structure itself is stationary.

U.S. Pat. No. 4,568,955 issued on Feb. 4, 1986, to Hosoya et al., discloses a development electrode type recording apparatus wherein a visible image based on image information is formed on an ordinary sheet by a developer. The recording apparatus comprises a donor roller spaced at a predetermined distance from and facing the ordinary sheet and carrying the developer thereon, a recording electrode and a signal source connected thereto for propelling the developer on the developing roller to the ordinary sheet by generating an electric field between the ordinary sheet and the developing roller according to the image information, and a plurality of mutually insulated electrodes provided on the developing roller and extending therefrom in one direction. An AC and a DC source are connected to the electrodes, for generating an alternating electric field between adjacent ones of the electrodes to alone cause oscillations of the developer found between the adjacent electrodes along electric lines of force therebetween to thereby liberate the developer from the developing roller, and to thereby form the toner particles into smoke in the vicinity of the donor roller and the sheet.

U.S. Pat. No. 5,010,367 granted to Hays on Apr. 23, 1991, relates to a development electrode type non-interactive development system for use in color imaging. To control the developability of lines and the degree of interaction between the toner and receiver, an AC voltage alone is applied between a donor roll and electrodes supported adjacent to the surface of the donor roll to enable detachment of toner from the donor to form a toner cloud. An AC voltage applied between the donor roll assembly and an image receiver serves to position the cloud in close proximity to the image receiver for optimum development of lines and solid areas without scavenging a previously toned image.

U.S. Pat. No. 4,833,503 granted to Snelling on May 23, 1989, is directed to a multi-color printer using a conventional vibratory or acoustic type apparatus. In it, vibratory energy only is provided by a sonic toner release development system in an attempt to develop either partial or full color images with minimal degradation by subsequent over-development.

U.S. Pat. No. 4,647,179 issued Mar. 3, 1987, to Schmidlin, discloses a development electrode type development apparatus including only a traveling electrostatic AC wave conveyor for transporting toner particles from a development housing to an imaging surface. The traveling electrostatic AC wave conveyor comprises a linear array of spaced apart conductive electrodes and a phase shifted multiphase AC voltage source connected to the electrodes for creating the wave.

U.S. Pat. No. 4,868,600 issued Sept. 19, 1989, to Wayman et al., discloses a development electrode type development apparatus in which AC electric fields alone are applied to self-spaced electrodes positioned within a development nip. The electrodes are mounted at their ends to bearing blocks, and are self-spaced from the donor member by toner particles.

Non-interactive development as practiced for example in a development electrode type development apparatus, typically depends only upon electrostatic fringe fields to disturb charged toner particles residing on a donor surface for the purpose of development of a latent electrostatic image in a noninteractive manner. In fact, in the type of development units having exposed electrode wires within the development nip, relatively high level AC fields are typically required, in part, for generating an avalanche like effect in order to release additional toner particles from the donor. As such, the electrostatic fringe fields must be at a level that is relatively high enough to overcome attractive forces between the toner particles and the donor member.

Unfortunately, such a relatively high fringe field undesirably will interact with a toner image being moved through it. This usually dictates that the process will be scavenging. Additionally using these relatively high fringe fields can sometimes lead to micro-arcing or corona discharge between the development electrodes and the donor member, leading either directly to non-uniform image defects, or to undesirable non-uniform coating of the electrodes.

Additionally, conventional development electrode type development units which have exposed electrode wires within the development nip often suffer from undesirable toner particle agglomeration on the electrode wires. Such agglomeration usually results in image defects such as development streaks, in final images.

On the other hand, non-interactive vibratory or acoustic type development units, (as disclosed in any of the relevant example references above), typically each utilizes vibratory energy alone to effect toner particle release from the development nip side of the donor member by mechanically reducing toner particle adhesion forces on the donor member. The vibratory energy alone therefore must be of a level high enough to effect such toner release, and additionally enable toner particle travel for image development across an air gap in the development nip within a d.c. electrostatic field. A lack of uniformity of vibratory motion in the development nip necessary over the full length of the donor roll to accelerate the toner particles to release from the donor member is an issue for these devices. Alternatively, if designed to vibrate over the full circumference such required levels of vibratory energy for toner release on the development nip side of the donor member tend to simultaneously and detrimentally affect developer material loading to the donor member on the opposite side thereof, thus placing mechanical strains and toner control conflicts on this type of development unit.

BRIEF SUMMARY OF THE INVENTION

In accordance with the present invention, there is provided an acoustic scavengeless assist (ASA) development apparatus, and a multicolor image reproduction machine including such a development apparatus. The (ASA) development apparatus of the present invention includes a biased vibratory toner release section having a piezoelectric member and a donor member for presenting toner particles to latent electrostatic images in a development nip for image development. The donor member is positioned within the reproduction machine and forms a development nip with a latent image bearing surface of a photoreceptor of the reproduction machine. Importantly, the vibratory toner release section has at least a first conductive electrode formed therein for activating the piezoelectric member to effect controlled vibratory toner release from the donor member, and a first bias for biasing the at least first conductive electrode. The (ASA) development apparatus also includes in combination, a biased development electrode section having a set of second conductive electrodes and a second bias therefor. The biased development electrode section is located between the at least first conductive electrode and the latent image bearing surface of the reproduction machine, for enhancing toner particle release from the donor member, as well as, powder cloud formation within the development nip, thus providing increased toner release control and reduced image degradation of a previously developed image when subsequent latent images are developed with different color toners.

DESCRIPTION OF THE DRAWINGS

In the detailed description of the invention presented below, reference will be made to the drawings, in which.

DETAILED DESCRIPTION OF THE PREFERRED EMBODIMENT OF THE INVENTION

This invention relates to an imaging or reproduction system which is used to produce a multi-color output image. It will be understood that it is not intended to limit the invention to the embodiment disclosed. On the contrary, it is intended to cover all alternatives, modifications and equivalents as may be included within the spirit and scope of the invention as defined by the appended claims.

Figure 1:
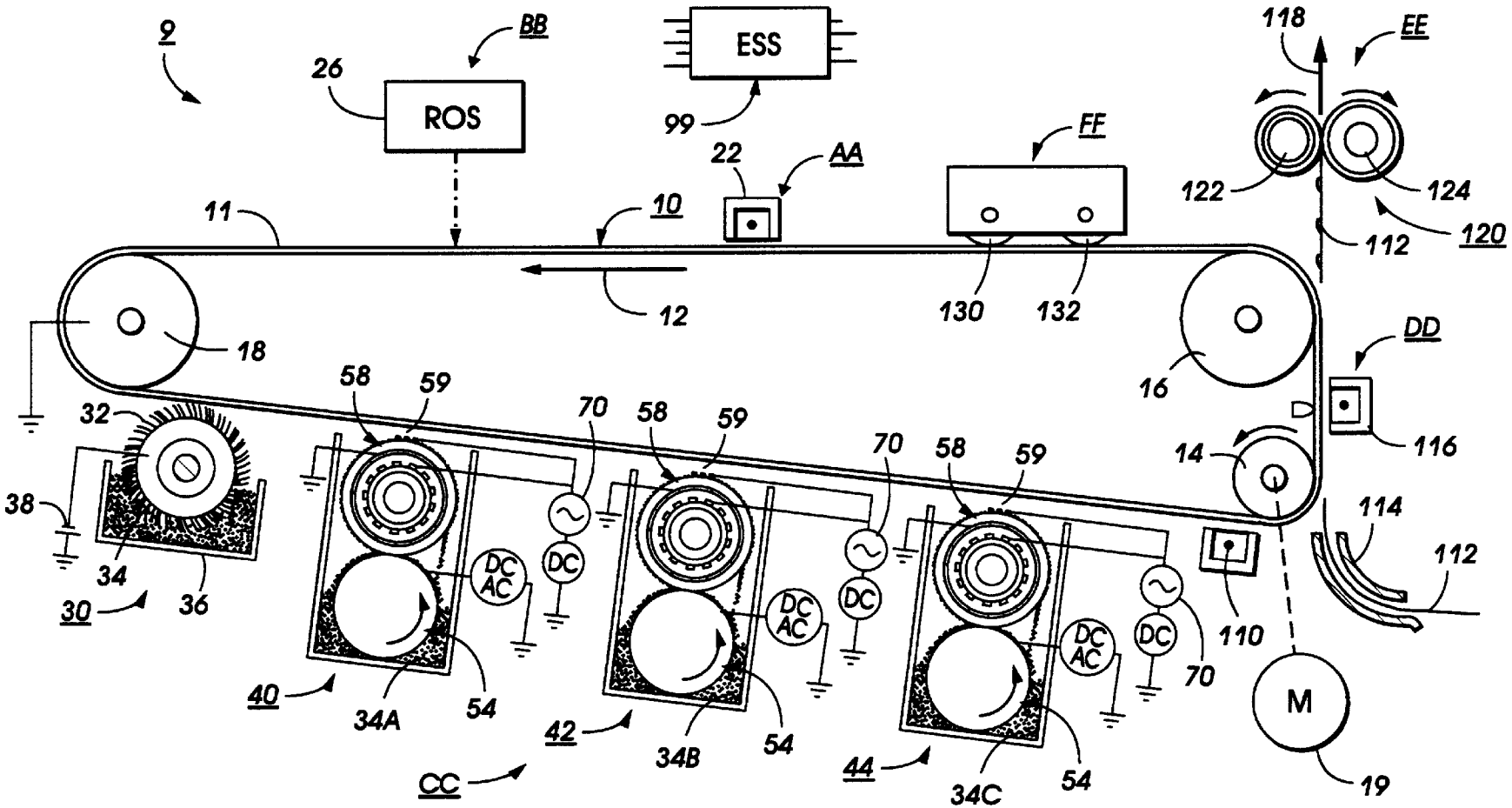
FIG. 1 is a schematic illustration of a multicolor image reproduction machine including an acoustic scavengeless assist (ASA) development apparatus in accordance with the present invention.

FIG. 1 schematically depicts the various components of an illustrative electrophotographic reproduction machine 9 that incorporates the acoustic scavengeless assist (ASA) development apparatus of the present invention. As shown in FIG. 1, the electrostatographic reproduction machine 9, includes a monopolar photoreceptor belt 10 having a photoconductive surface 11 that is formed on a conductive substrate. Belt 10 moves in the direction indicated by arrow 12, advancing sequentially through various types of xerographic process stations, as are well known. The belt is entrained about a drive roller 14 and two tension rollers 16 and 18. The roller 14 is operatively connected to a drive motor 19 for effecting movement of the photoreceptor belt 10 in an endless path.

With continued reference to FIG. 1, a portion of belt 10 passes through charging station M where a corona generating device, indicated generally by the reference numeral 22, charges the photoconductive surface 11 of belt 10 to a relative high, and substantially uniform, negative potential, for example.

Next, the uniformly charged portions of the surface 11 are advanced through exposure station BB. At exposure station BB, the uniformly charged photoreceptor or charge retentive surface 11 is exposed to a laser Raster Output Scanner (ROS) device 26 which causes the charge retentive surface 11 to be discharged in some areas in accordance with the output from the scanning device. Although the ROS device could be replaced by a (conventional xerographic exposure device, preferably the ROS device 26 is a three level device suitable for performing tri-level latent imaging.

Tri-level latent imaging for highlight color xerography is described, for example, in U.S. Pat. No. 4,078,929 issued in the name of Gundlach, (and incorporated herein by reference). Tri-level xerography is used typically as a means for achieving single-pass highlight color imaging. In highlight color imaging achieved thus, xerographic contrast on the charge retentive surface 11 of the photoreceptor is divided into three levels, rather than into two levels, as is the case in conventional xerography.

In tri-level imaging, the charge retentive surface 11 of the photoreceptor is initially charged to a voltage $V_0$, which is typically larger in magnitude than −900 volts, but which after undergoing some dark decay, is reduced to a stable photoreceptor voltage $V_{ddp}$ of about −900 volts. The surface 11 is then exposed imagewise such that one image, corresponding to charged image areas (which are subsequently developed using charged-area development, (CAD) techniques, stays at the full photoreceptor potential of $V_{CAD}$ equal to $V_{ddp}$).

To form the other or second image, the surface 11 is also exposed so as to discharge the photoreceptor to a residual potential, $V_{DAD}$ equal to $V_c$ which is typically about −100 volts. The other or second image thus corresponds to areas discharged to the residual potential, and which are subsequently developed using discharged-area development (DAD) techniques. To form the background areas (the third level), the surface 11 is next also exposed so as to reduce the photoreceptor potential in such background areas to a level $V_{white}$ or $V_w$ (typically −500 volts), which is halfway between the $V_{CAD}$ and $V_{DAD}$ potentials. Following such tri-level latent image formation, the surface 11 is advanced to the development station CC.

At development station CC, a plurality of development units are provided, and include a magnetic brush development unit, and several units of the non-interactive (ASA) development apparatus of the present invention (several embodiments of which will be described in detail below). For developing the first latent CAD image at $V_{CAD}$, at the development station CC, a magnetic brush development unit, indicated generally by the reference numeral 30, is provided for advancing developer material 34 into contact with the CAD electrostatic latent images on the surface 11. As shown, the development unit 30 comprises at least a magnetic brush 32, and a supply of two-component developer material 34 contained in a developer housing 36. The two-component developer material 34 comprises a mixture of carrier beads and black toner particles, along with additives as needed for specific applications.

For the negatively charged, CAD image development, the black toner particles are positively charged. As shown, a suitable negative developer bias is applied to the developer unit 30 from a DC power source 38. The CAD development unit 30 is typically biased about 100 volts closer to $V_{CAD}$ than $V_{white}$ (therefore at about −600 volts).

Magnetic brush development as provided by the unit 30 is an interactive unit, with the developer unit directly interacting with the image being developed. However, it is suitable for developing the CAD images because it is the first development unit in a multiple development unit, single pass process machine. As such, toner developed images do not have to be moved through and past its development fields, and hence there is no risk of scavenging and image degradation from its fields. There are however such risks with respect to the other multiple development units mounted downstream of the unit 30 in such a machine, particularly as here, for developing the discharged area development, or DAD, images.

Accordingly, the discharged area development or DAD images, are preferably developed using the non-interactive (ASA) development units of the present invention, shown generally as 40, 42 and 44 (to be described in detail below). The development units 40, 42, and 44 are each biased about −100 volts closer to $V_{DAD}$ than $V_{white}$ (therefore at about −400 volts).

Still referring to FIG. 1, a color controller (ESS) 99 and user interface (not shown) provide means for user selection of the final color for the DAD image. The user interface, for example, may comprise a plurality of control knobs, one for each non-interactive development unit. By reference to a color palette, not shown, the user can obtain the settings for the control knobs. For example, once a specific color is identified by the user the setting of these knobs determines the individual biases for the development units. In addition, since the photoreceptor contains both positive and negative toner particles thereon, a pre-transfer corotron 110 is provided for effecting a unipolar image prior to transfer at a transfer station DD.

After the electrostatic latent image has been subjected to the pre-transfer corotron 110, the photoreceptor belt advances the toner powder images to transfer station DD. A copy sheet 112 is advanced to transfer station DD by sheet feeding apparatus, not shown. Preferably, the sheet feeding apparatus includes a feed roll contacting the uppermost sheet of a stack of sheets. The feed roll rotates to advance the uppermost sheet from the stack into chute 114. Chute 114 directs the advancing sheet into contact with photoconductive surface 11 of belt 10 in a timed sequence so that the toner powder images developed thereon contact the advancing sheet at transfer station DD. Transfer station DD includes a corona generating device 116 which sprays ions onto the back side of sheet 112. This attracts the toner powder image from photoconductive surface 11 to sheet 112. After transfer, sheet 112 continues to move in the direction of arrow 118 onto a conveyor (not shown) which advances sheet 112 to fusing station EE.

Fusing station EE includes a fuser assembly, indicated generally by the reference numeral 120, which permanently affixes the transferred powder image to sheet 112. Fuser assembly 120 includes a heated fuser roller 122 and back-up roller 124. Sheet 112 passes between fuser roller 122 and back-up roller 124 with the toner powder image contacting fuser roller 122. In this manner, the toner powder image is directly heated and permanently affixed to sheet 112. After fusing, sheet 112 advances through a chute, not shown, to a catch tray, also not shown, for subsequent removal from the reproduction machine by the operator.

After the copy sheet is separated from photoconductive surface 11 of belt 10, the residual toner particles adhering to photoconductive surface 11 are removed therefrom at cleaning station FF. Cleaning station FF may include rotatably mounted fibrous brushes 130, 132 in contact with photoconductive surface 11. Subsequent to cleaning, a discharge lamp (not shown) floods the photoreceptor with light to dissipate any residual electrostatic charge remaining thereon prior to the charging thereof for the next successive imaging cycle.

Referring now to FIGS. 1, 2A, 2B, 3, and 4, each of the acoustic scavengeless assist (ASA) development units 40, 42 and 44 as used in the machine 9 is identical to the others in this group, except for the particular color of toner particles each contains. Additionally, the set of units 40, 42, and 44 can be of either of the embodiments of FIGS. 2A, 2B, 3, or 4. In accordance with the present invention, each of the units 40, 42 and 44 contains and is adapted to selectively deposit varying amounts of appropriately charged, color (other than black) toner particles, onto the DAD portion of the tri-level image in a highlight color machine as shown, or onto appropriate color separation images in a full process color machine. For example, these non-interactive development units 40, 42, 44 may contain and selectively deposit negatively charged, magenta, yellow and cyan toners, respectively, on the DAD images.

In each of the embodiments disclosed below, the representative (ASA) development apparatus 50, 72, 82 of the acoustic scavengeless assist (ASA) development apparatus (40, 42, 44) of the present invention, each advantageously comprises a biased vibratory toner particle release section 46, and a common bias source, biased development electrode section 48, for producing synergistic increased toner release control and reduced image degrading electrostatic fields, thereby resulting in relatively higher quality image development.

Figure 2A:
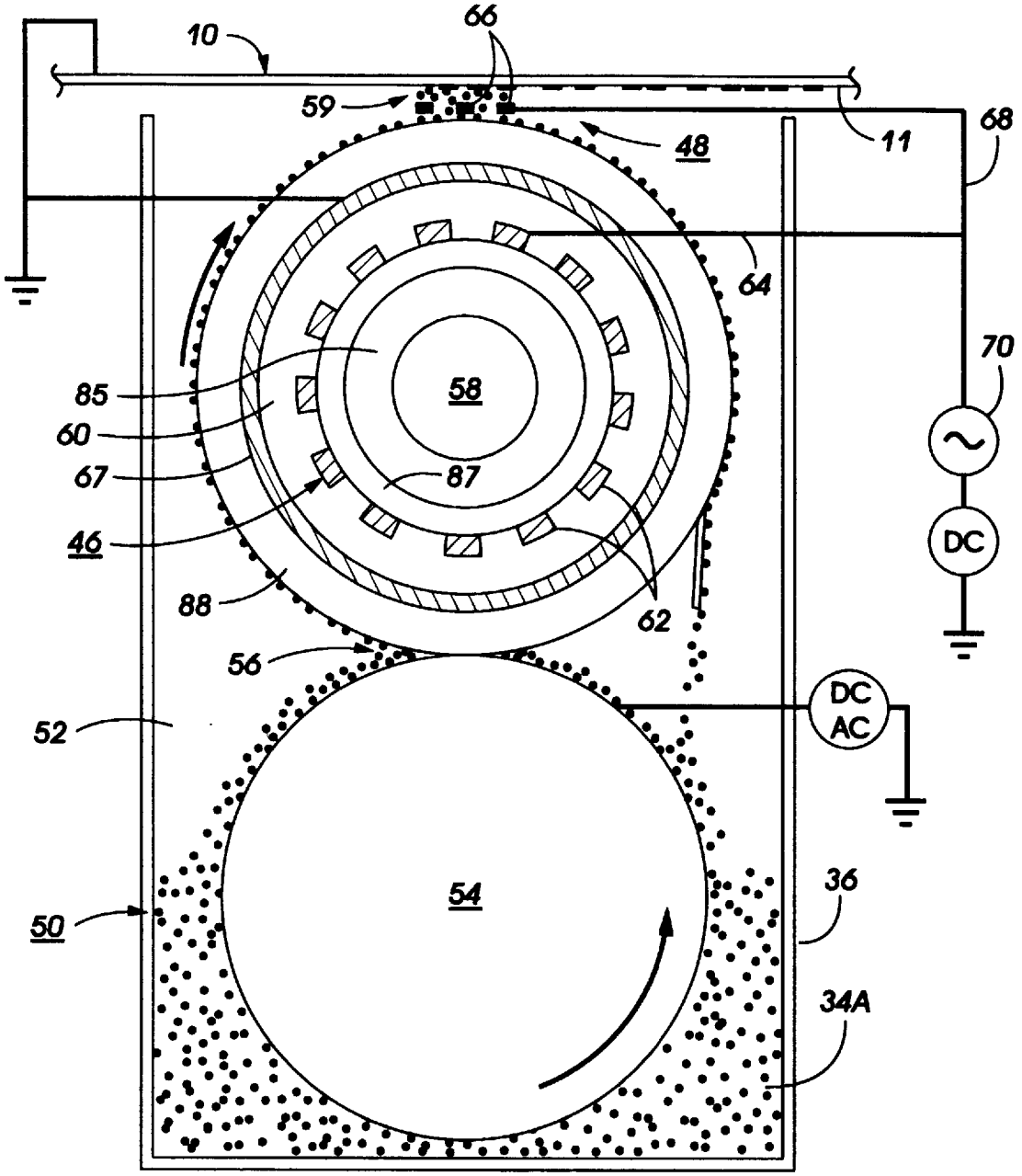
FIGS. 2A and 2B are each an enlarged schematic illustration of the (ASA) development apparatus of FIG. 1.
Figure 2B:
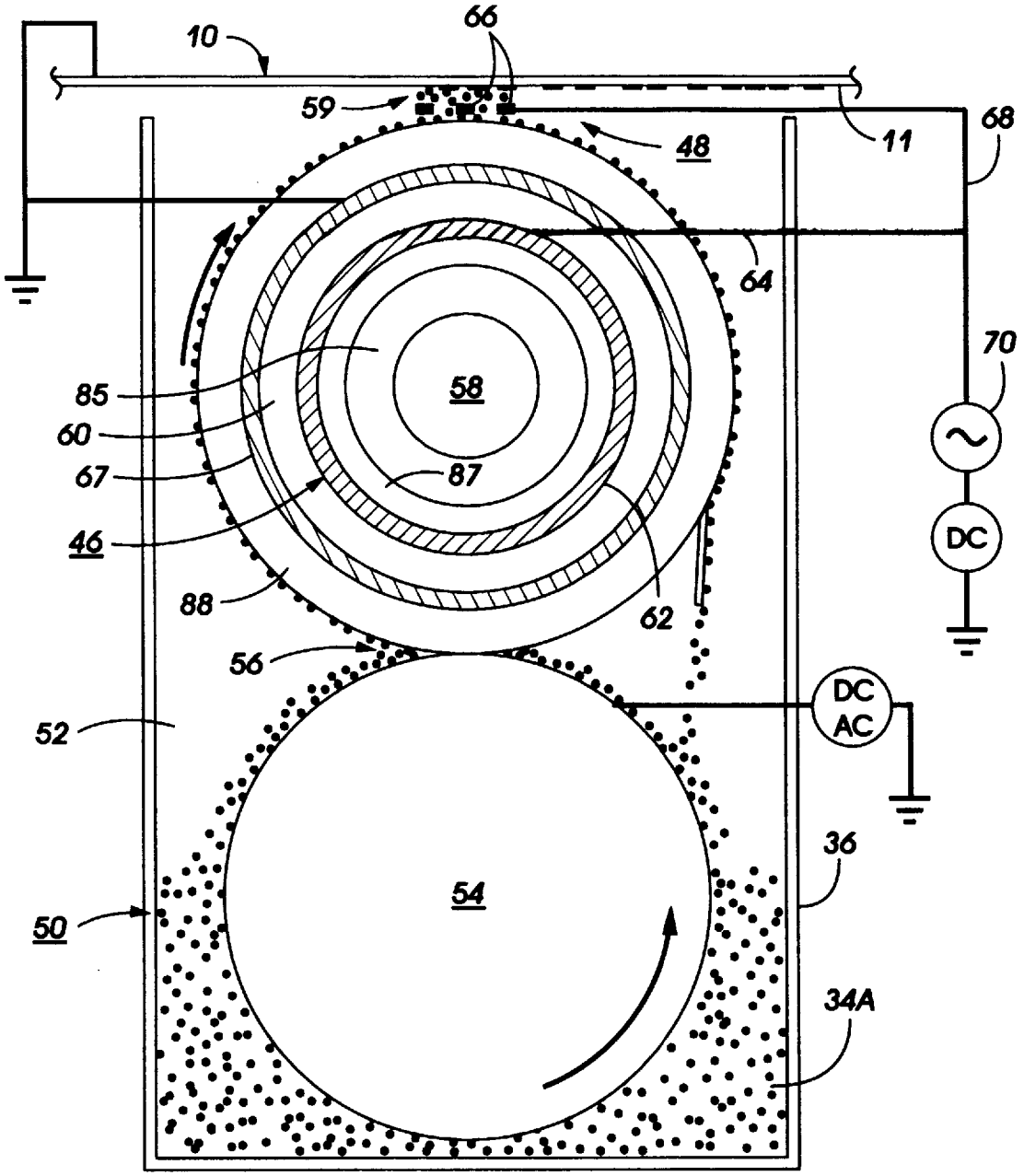

Referring in particular to FIGS. 1, 2A and 2B, a first embodiment of the (ASA) non-interactive development unit (40, 42, 44) of the present invention is illustrated generally as 50. The representative apparatus 50 includes a development housing 36 defining a sump 52 containing developer material 34A as shown, or 34B, 34C of a non-black color, for example magenta, cyan, yellow. The developer material 34A, 34B, 34C is mixed and triboelectrically charged within the sump 52 by mixing augers (not shown), and picked up by a feeder magnetic roll 54. The picked up developer material serves to electrostatically load toner at a nip 56 from the magnetic roll 54 onto a donor assembly that includes a vibratory section 46 and a vibratable toner releasing donor member 58. The vibratable toner releasing donor member 58 is preferably shown in the form of a piezoelectric roller, but equally can be in belt form. As shown, the (ASA) development unit 50 is mounted within a machine such that the piezoelectric member or roller 58 forms a development nip 59 with the surface 11 of the latent image bearing member 10, for presenting toner particles to latent electrostatic images on the surface for image development.

The piezoelectric member or roller 58 as shown, is multilayered, and includes a piezoelectric member in the form of a layer 60, and at least a first, single, solid conductive electrode 62 (FIG. 2B), or a first set of conductive electrodes (FIG. 2A) 62, formed therein for activating or exciting the piezoelectric member or layer to effect controlled vibratory toner release from an outer surface of the donor member or roller 58. As illustrated, a first bias 64 is provided for biasing the first conductive electrode or set of conductive electrodes 62. As further shown, the multilayered roller 58 includes a support layer 85, a conformable layer 87 above the support layer 85 but underneath the piezoelectric layer 60, and an electrically relaxable top layer 88. Also shown, is a biased conductive layer 67, serving as a reference electrode for the biased development electrode section 48, and to accommodate biasing for toner development purposes, is preferably also provided.

Importantly, the (ASA) development apparatus 50 includes in combination with the biased vibratory toner release section 46 (including the piezoelectric member and donor member or roller 58), the biased development electrode section 48. As shown, the section 48 includes a second set of conductive electrodes 66, and a second bias 68 therefor. As shown, the second set of conductive electrodes 66 comprises exposed wire electrodes located between the biased vibratory toner release section 46 (that includes the at least first electrode 62) and the latent images on surface 11 of the image bearing member 10. Advantageously, the biased development electrode section 48 synergistically assists and enhances toner particle release from the donor member or roller 58, as well as, forms a toner powder cloud of released toner particles within the development nip 59 for producing relatively high quality image development.

It should be noted that a fully circumferential vibration of the donor member or roller 58 applied without the combination approach of the present invention would tend to inhibit toner loading (from a magnetic brush 54 to the donor member or roller 58). However, in accordance with the present invention, it is advantageously possible and preferable, to maintain acoustic energy levels and accelerations of the biased vibratory section 46, sufficiently low enough so that such toner loading within the nip 56 (from the magnetic brush roller 54 onto the donor member or roller 58), is not adversely affected.

In accordance with another aspect of the present invention, the first bias 64 and the second bias 68 are advantageously supplied from a common AC bias source 70. Thus, in accordance with the present invention, the AC field from the development electrode wires 66 is advantageously used to excite the piezoelectric layer 60. This arrangement thus economically provides the piezoelectric commutated bias with little additional cost. In addition, in this arrangement the first electrode or set of electrodes 62 does not suffer from the problem of continuous excitement, as is the case with conventional or per se piezo-vibratory development systems.

Figure 3:
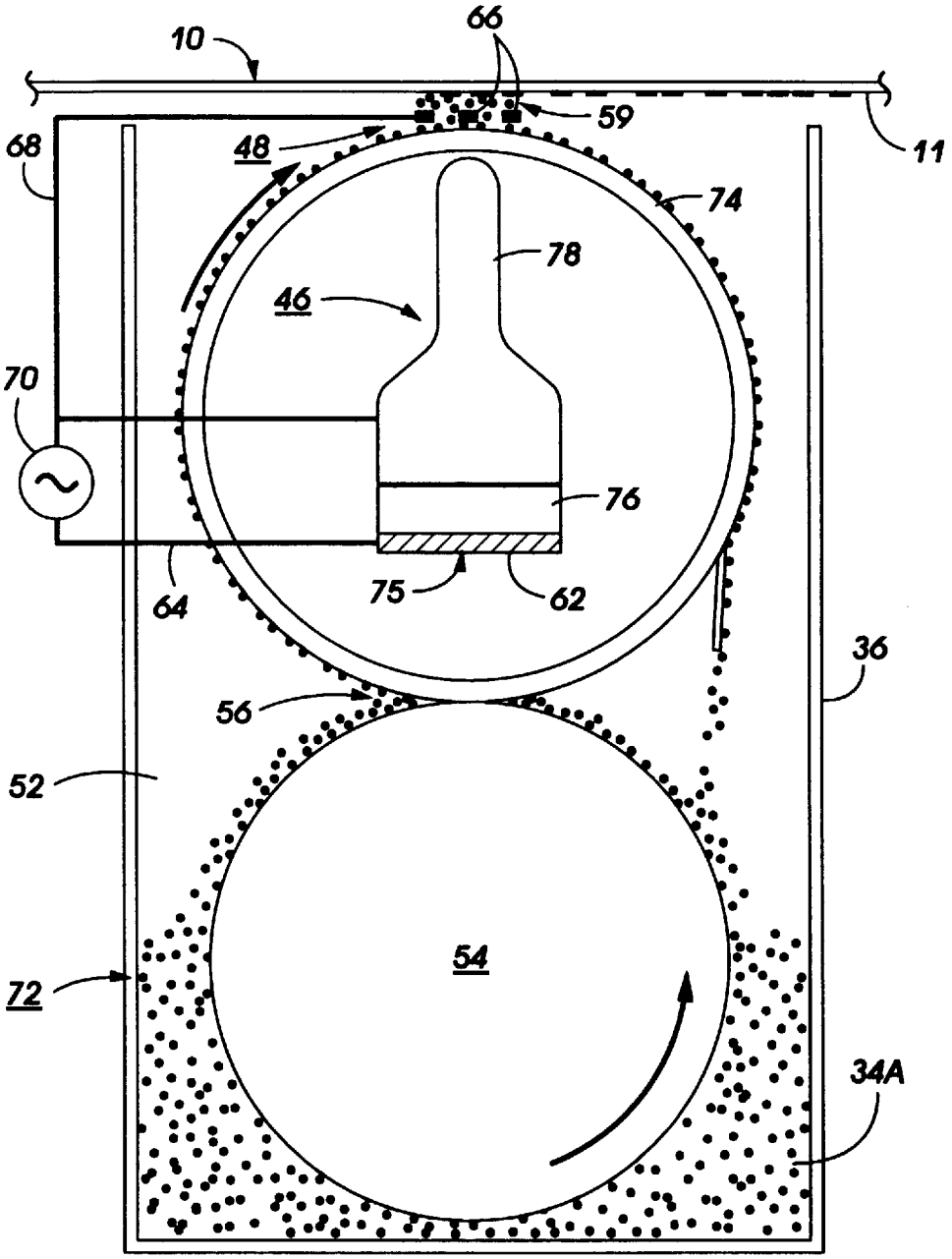
FIG. 3 is a schematic illustration of a second embodiment of the (ASA) development apparatus of the present invention.

Now, referring in particular to FIGS. 1 and 3 a second embodiment of the (ASA) non-interactive development unit (40, 42, 44) of the present invention is illustrated generally as 72. Similarly, the representative apparatus 72 includes a development housing 36 defining a sump 52 containing developer material 34A as shown, or 34B, 34C of a non-black color, for example magenta, cyan, yellow. The developer material 34A, 34B, 34C is mixed and triboelectrically charged within the sump 52 by mixing augers (not shown), and picked up by a feeder magnetic roll 54. The picked up developer material serves to electrostatically load toner at a nip 56 from the magnetic roll 54 onto a vibratory section 46, of the apparatus 72. As illustrated, the vibratory section 46 comprises an acoustic vibratory assembly 75 and a rotatable toner releasing donor member 74 shown in the form of a roller, but equally can be a belt. The (ASA) development unit 72 will be mounted within a machine such that the acoustic vibratory donor member or roller 74 forms a development nip 59 with the latent image bearing member surface 11 for presenting toner particles to latent electrostatic images on the surface for image development.

As shown, the acoustic assembly 75 includes a piezoelectric material portion shown as layer 76, a first conductive electrode layer 62 formed beneath the piezoelectric layer 76, and a vibratable waveguide or horn transducer portion 78. The acoustic assembly 75 is mounted such that the horn portion 78 is adjacent or in contact with the piezoelectric material portion, and with the donor member or roller 74 along a point within the development nip 59 for effecting controlled vibratory toner release from an outer surface of the donor member 74 into the development nip 59. Although the donor member 74 is illustrated simply as a single layer device, it can also include a relaxable top layer (not shown), and a biasable conductive layer (not shown) as a reference layer for the development electrode wires 66, and bias 68. A bottom surface insulative layer (not shown) may also be added to avoid shorting to the usually conductive waveguide 78. As illustrated, a first bias 64 is provided for biasing the first conductive electrode 62 of the acoustic assembly 75.

Importantly, the second embodiment 72 in accordance with the present invention, includes in combination with the biased vibratory section 46, a biased development electrode section 48 that includes a set of second conductive electrodes 66, and a second bias 68 therefor. As shown, the set of second conductive electrodes 66 in this embodiment comprises exposed development electrode wires located between the biased vibratory toner release section 46 (that includes the first electrode 62) and latent images on surface 11 of the image bearing member 10. Again, the biased development electrode section 48 of this embodiment synergistically assists a common source biased vibratory section 46 thereof by enhancing toner particle release from the donor member or roller 74, as well as, forms a toner powder cloud of released toner particles within the development nip 59 for producing relatively higher quality image development.

Further, in this embodiment the donor member 74 is advantageously vibrated only within an isolated region thereof that is moving through the development nip 59. This alleviates adverse effects of donor loading with the magnetic brush 54. Isolated region vibration as disclosed herein can also be accomplished using a number of other different devices other than that disclosed. For example, such other different devices can include electromagnetic transducers, magnetostrictive devices, or pneumatic devices.

Within the development nip 59, the AC fields of the second set of electrodes 66 also serve to release toner particles from the donor member 74 for image development. Importantly, the AC fields from the set of second electrodes 66 in addition to simply releasing toner from the donor roll 74, also serve additionally to propel the toner particles within the development nip gap 59 to a certain, but important, extent. In fact without this additional propulsion, there would be an undesirable isolation of developed line dots. Similarly, such an additional propulsion effect is also true of AC field biasing of the donor member 74.

Figure 4:
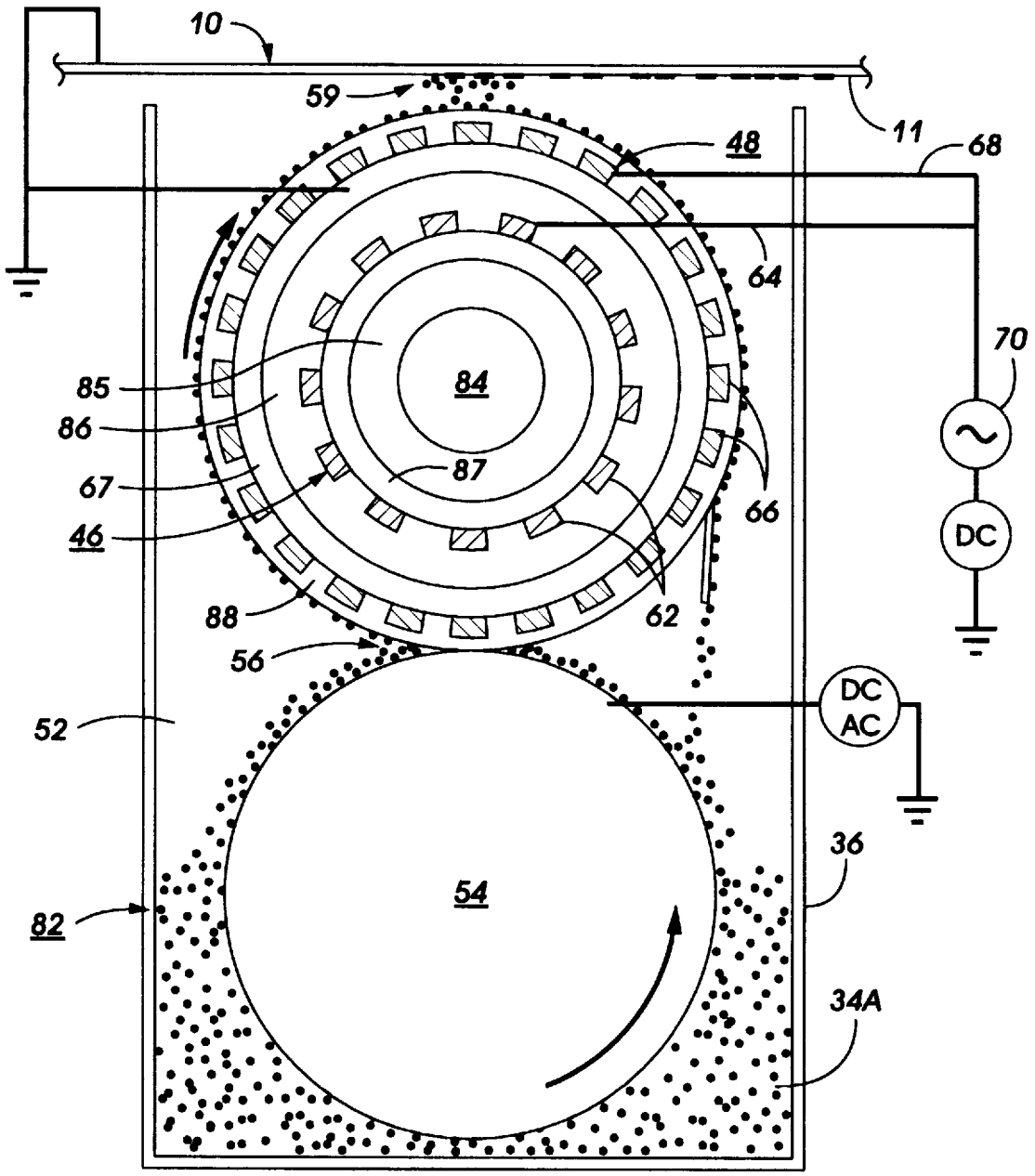
FIG. 4 is a schematic illustration of a third embodiment of the (ASA) development apparatus of the present invention.

Referring next and in particular to FIG. 4, a third embodiment of the (ASA) non-interactive development unit (40, 42, 44) of the present invention is illustrated generally as 82. Similarly the embodiment 82 includes a development housing 36 defining a sump 52 containing developer material 34A as shown, or 34B, 34C (FIG. 1) of a non-black color, for example magenta, cyan, yellow. The developer material 34A, 34B, 34C (FIG. 1) is mixed and triboelectrically charged within the sump 52 by mixing augers (not shown), and picked up by a feeder magnetic roll 54. As shown, the embodiment 82 advantageously similarly combines a biased vibratory toner release section 46, and a biased development electrode section 48 for producing synergistic and relatively higher quality image development results. This embodiment is similar to the others (50, 72), except that both the vibratory section 46 including the first or first set of conductive electrodes 62, and the development electrode section 48 including the second set of conductive electrodes 66, are formed within a single multilayered composite (ASA) donor member 84.

As illustrated, the multilayered composite (ASA) donor member 84 is a roller, but can equally be a belt member, and includes individual electrode structures 62, 66 for each of the two functions (vibratory toner release, and electrostatic toner release and development). The composite donor member 84 includes a biased vibratory section 46 comprising a support structure 85, the first set of conductive electrodes 62 formed over the support structure 85, a piezocomposite member in the form of a layer 86 formed over the first set of electrodes 62, and a first bias 64 for biasing the first set of electrodes 62. The composite donor member 84 also includes a biased development electrode section 48 comprising the second set of conductive electrodes 66, a biased reference layer 67, a relaxable overcoat layer 88 formed over the second set of electrodes 66, and a second bias 68 for biasing the electrodes 66.

Preferably, the piezocomposite layer 86 is an insulative layer that includes piezoelectric material, such as a piezoceramic/polymer composite material. Such a material of the layer 86, and materials of the overcoat layer 88 preferably are each blended with an elastomer in order to make each of the layers 86, 88 compliant, thus enabling or allowing for movement or vibration of the layer of the donor member or roller 84 as imparted by the activation of the piezoelectric material.

By optimizing the piezoelectric properties of the layer 86, in conjunction with the layer thickness and compliancy of each of the layers 86, 88, the biasing aspect of the present embodiment of the invention can be achieved such that the same AC source 70, can be utilized to provide both the fringe field electrostatic removal forces, as well as a signal necessary for generating the toner release vibrations. The electrical signal necessary for exciting the piezoelectric layer 86 of the vibratory section 46, and that for producing the AC fields of the second set of electrodes 66, preferably are each commutated in this embodiment in order to achieve isolated region vibration and toner release. This approach permits optimization of the two physical effects of the (ASA) development apparatus.

The (ASA) development apparatus and techniques of the present invention are particularly appropriate for reproduction machines requiring low development noise, as well as, for multicolor image on image machines. The combined electrostatic (48) and acoustic (46) sections of an (ASA) development apparatus (50, 72, 82) work in conjunction with one another in order to provide relatively greater control over the release and transfer of xerographic development toners. The combination also serves to alleviate constraints placed upon the properties of toner materials as toner flow is enhanced by the inclusion of vibratory energy due to the reduced cohesive and adhesive forces with the donor member surface. Thus with sufficient developability control, the ability to perform variable level development may be more easily afforded, further improving achievable quality of xerographic image development.

Combining the two concepts provides synergistic and additional control over toner release, toner powder cloud formation, and latent image development, such that constraints conventionally placed on a development apparatus based on either concept alone, may be significantly reduced. With increased toner release, or in other words with an apparent reduction in toner adhesion due to the concurrent effects of the ultrasonic or vibratory energy section, as perceived from the development electrode section of the (ASA) development apparatus, the electric field requirements of the development electrode section, both DC as well as AC, for toner removal can therefore be reduced below what they would otherwise be in a conventional development electrode only apparatus. Similarly, with the assistance provided by the less than conventional level development electrode fields for toner removal via electrostatic forces of the AC fields, for example, the energy level requirements, and hence the accelerations and vibration levels required of a conventional vibratory energy only apparatus, can also be relaxed. It is believed too that inconsistencies which occur within the process of each conventionally uncombined type of vibratory alone or development electrode alone apparatus, will be overcome by the (ASA) combination of the present invention.

Therefore, with less than conventionally required levels of electrostatic development fields or of piezoelectric vibrations, a desired and predictable amount of toner particles can thus be released, in accordance with the present invention, from the donor member into the development nip, due to the combined effects of the first and second set of electrodes.

In each of the disclosed embodiments, the piezoelectric donor member preferably is in the form of a roller as compared to a belt to simplify the mechanical drive configuration. The first set of electrodes within the piezoelectric donor roller are typically spaced about the circumference of the roller, preferably on the outside of a core or support structure of the roller. In the case of a rotating donor roller, the first bias 64 is commutated to the first set of electrodes of the donor roller such that an electrical potential is applied to each electrode of the first set of electrodes as it is rotated by the donor roller through the development nip. The second bias 68 is also commutated to each electrode of the second set of electrodes within the development nip where the set of second electrodes is isolated one from another and rotate with the roller.

In each of the embodiments, any excess propagation of acoustic motion of the piezoelectric donor roller, in a pre-nip area or a post-nip area of the development nip, may be eliminated by an active damping technique using phase shifted voltages to bias adjacent electrodes. Preferably, such propagation may also be eliminated by using acoustic damping properties of a dielectric support material layer formed over, and embedding, the first set of electrodes.

Advantageously therefore, in accordance with each of the embodiments 50, 72, 82 of the (ASA) development apparatus of the present invention, combination of a biased vibratory section with a common source, biased development electrode section, synergistically reduces (relative to uncombined techniques), the bias requirements, the vibratory energy requirements, and the electrostatic force requirements of the fringe fields of the biased development electrode wires (66). In addition, the combination advantageously serves to reduce toner particle agglomeration on, and in the vicinity of, the electrode wires 66, thus preventing developed image defects such as development streaks.

In general, the development electrode section 48 of each of the various embodiments of the (ASA) development apparatus of the present invention can take on any of the already disclosed improvement variations of an electroded development techniques. Such techniques include, for example, a progressive ultrasonic wave donating surface technique with AC electrodes, or an AC biased electrostatic traveling wave donating surface technique. In the alternatives which have a non-rotating donor surface and thus transport toner via wave motion, the non-rotating donor surface offers an advantage in that there is therefore no need to commutate the bias.

As can be seen, there has been provided a multicolor reproduction machine, and an advantageous non-interactive (ASA) development apparatus according to the present invention. In the (ASA) development apparatus, a less than conventional level AC field is required by a biased set of development electrodes and is combined synergistically with less than conventional level piezoelectric vibratory energy, for relatively higher quality image development. The advantages of the (ASA) development apparatus, for example, include increased toner release from the piezoelectric donor member surface, and reduced AC fields, and hence reduced risks of image degradation from such fields.

What is claimed is:

1. An electrostatographic reproduction machine for creating toner images, the reproduction machine comprising:

(a) a movable image bearing member supported for movement in an endless path;

(b) means for forming latent electrostatic images on said image bearing member;

(c) an acoustic scavengeless assist (ASA) development apparatus for developing the latent electrostatic images using charged toner particles, said (ASA) development apparatus including a biased vibratory toner release section and a development electrode section, said biased vibratory toner release section including a movable donor member forming a development nip with said image bearing member, a piezoelectric member, and at least a first conductive electrode for activating said piezoelectric member to effect release of charged toner particles from said donor member, and said development electrode section including a second set of conductive electrodes located between said biased vibratory toner release section and said image bearing member for enhancing charged toner particles release from said donor member, and for forming a powder cloud of released toner particles within said development nip to produce relatively higher than conventional quality image development.

2. The reproduction machine according to claim 1, wherein said second set of conductive electrodes comprises exposed development electrode wires located within said development nip between said donor member and said image bearing member.

3. The reproduction machine according to claim 1, wherein said piezoelectric member comprises a piezoelectric layer within said donor member.

4. The reproduction machine according to claim 1, wherein said piezoelectric member comprises a piezoelectric acoustic assembly including piezoelectric material and a vibratable horn member mounted in contact with said donor member.

5. The reproduction machine according to claim 1, wherein said vibratory toner release section and said development electrode section are both formed within a single composite donor member.

6. The reproduction machine according to claim 1, including a first voltage means for applying a bias voltage commutatively to each conductive electrode of said at least first conductive electrode, whereby an isolated area of said piezoelectric member is caused to acoustically vibrate for effecting release of toner from said donor member.

7. The reproduction machine according to claim 6, including a second voltage means for applying a development bias voltage to each conductive electrode of said second set of conductive electrodes within said development nip for image development and for enhancing toner particles release from said donor member, whereby a level of said development bias needed, and that of acoustic energy needed for effective toner particle release and image development, are each less than required in a conventional development apparatus.

8. The reproduction machine according to claim 6, wherein said donor member has a piezoelectric layer and comprises a donor roller in order to provide relatively less acoustic activity in the development nip.

9. The reproduction machine according to claim 7, wherein said first voltage means and said second voltage means comprise a common voltage source.

10. The reproduction machine according to claim 8, wherein said at least first conductive electrode are formed in contact with said piezoelectric layer and electrodes thereof are spaced circumferentially within said donor roll.

11. The reproduction machine according to claim 8, wherein said donor roll includes an electrically relaxable layer formed over said piezoelectric layer.

12. An acoustic scavengeless assist (ASA) development apparatus for developing latent electrostatic images in a reproduction machine using charged toner particles, the (ASA) development apparatus comprising:

(a) a development housing defining a sump for holding developer material containing the toner particles;

(b) first means mounted within said sump for transporting developer material within said sump; and (c) second means mounted partially within said sump for receiving toner particles from said first means and for transporting the toner particles through a development nip of a reproduction machine, said second means including a biased vibratory toner release section and a development electrode section, said biased vibratory toner release section including (i) a movable donor member for forming the development nip, (ii) a piezoelectric member, and (iii) at least a first conductive electrode for activating said piezoelectric member to effect release of charged toner particles from said donor member, and said development electrode section including a set of second conductive electrodes located between said biased vibratory toner release section and an image bearing member for enhancing charged toner particles release from said donor member, and for forming a toner powder cloud of released toner particles within the development nip for producing relatively higher than conventional quality image development.

13. The (ASA) development apparatus according to claim 12, wherein said set of second conductive electrodes comprises exposed development electrode wires located external to said donor member within the development nip.

14. The (ASA) development apparatus according to claim 12, wherein said piezoelectric member comprises a piezoelectric layer within said donor member.

15. The (ASA) development apparatus according to claim 12, wherein said piezoelectric member comprises a piezoelectric acoustic assembly including piezoelectric material and a vibratable horn member mounted in contact with said donor member.

16. The (ASA) development apparatus according to claim 12, wherein said biased vibratory toner release section and said development electrode section are both formed within a single composite donor member.

17. The (ASA) development apparatus according to claim 16, wherein said biased vibratory toner release section of said composite donor member includes a support structure, said at least first conductive electrode formed over said support structure, an insulative piezocomposite layer formed over said at least first conductive electrode, and a first bias for biasing said at least first conductive electrode.

18. The (ASA) development apparatus according to claim 17, wherein said development electrode section of said composite donor member includes said set of second conductive electrodes formed over said piezocomposite layer, a relaxable overcoat layer formed over said set of second conductive electrodes, and a second bias for biasing said set of second conductive electrodes.

* * * * *